US012000685B2

(12) United States Patent
Maurissens

(10) Patent No.: US 12,000,685 B2
(45) Date of Patent: Jun. 4, 2024

(54) ENERGY EFFICIENT WIRELESS DETONATOR SYSTEM

(71) Applicant: DETNET SOUTH AFRICA (PTY) LTD, Johannesburg (ZA)

(72) Inventor: Daniel Auguste Maurissens, Orbe (CH)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 177 days.

(21) Appl. No.: 17/639,508

(22) PCT Filed: Sep. 4, 2020

(86) PCT No.: PCT/ZA2020/050045
§ 371 (c)(1),
(2) Date: Mar. 1, 2022

(87) PCT Pub. No.: WO2021/051144
PCT Pub. Date: Mar. 18, 2021

(65) Prior Publication Data

US 2022/0290961 A1 Sep. 15, 2022

(30) Foreign Application Priority Data

Sep. 9, 2019 (ZA) ..... 2019/05911

(51) Int. Cl.
*F42D 1/055* (2006.01)
*F42D 3/04* (2006.01)

(52) U.S. Cl.
CPC ..... *F42D 1/055* (2013.01); *F42D 3/04* (2013.01)

(58) Field of Classification Search
CPC ... F42D 1/055; F42D 1/05; F42D 3/04; F42D 1/02; F42B 3/11; F42B 3/113
USPC ..... 102/206, 215, 262, 217, 218; 361/248
See application file for complete search history.

(56) References Cited

U.S. PATENT DOCUMENTS

| | | | | |
|---|---|---|---|---|
| 7,934,453 | B2 * | 5/2011 | Moore | F42B 3/10 102/293 |
| 8,994,515 | B2 * | 3/2015 | Guyon | F42D 1/055 102/311 |
| 9,366,518 | B2 * | 6/2016 | Guyon | F42D 1/055 |
| 9,587,925 | B2 * | 3/2017 | Garcia | F42D 1/055 |
| 10,429,162 | B2 * | 10/2019 | Papillon | F42D 5/00 |
| 11,441,883 | B2 * | 9/2022 | Maurissens | F42D 1/02 |
| 2008/0041261 | A1 | 2/2008 | Hummel et al. | |

(Continued)

FOREIGN PATENT DOCUMENTS

| | | | |
|---|---|---|---|
| WO | 2006076777 | A1 | 7/2006 |
| WO | 2015143501 | A1 | 10/2015 |

OTHER PUBLICATIONS

International Preliminary Report on Patentability for PCT/ZA2020/050045, international filing date of Sep. 4, 2020, date of completion Dec. 21, 2021, 10 pages.

(Continued)

*Primary Examiner* — Michael D David
(74) *Attorney, Agent, or Firm* — CANTOR COLBURN LLP

(57) ABSTRACT

A blasting system which includes a plurality of detonators located in respective boreholes each detonator being capable of two-way communication, and wherein a signal from control equipment is relayed from one detonator to another and then to a target detonator.

7 Claims, 3 Drawing Sheets

(56) References Cited

U.S. PATENT DOCUMENTS

| | | | | |
|---|---|---|---|---|
| 2009/0145321 | A1 | 6/2009 | Russell | |
| 2021/0302143 | A1* | 9/2021 | Maurissens | F42D 1/05 |
| 2021/0318107 | A1* | 10/2021 | Maurissens | F42D 3/04 |

OTHER PUBLICATIONS

International Search Report for PCT/ZA2020/050045, international filing date of Sep. 4, 2020, date of mailing May 4, 2021, 5 pages.
Written Opinion for PCT/ZA2020/050045, international filing date of Sep. 4, 2020, date of mailing May 4, 2021, 9 pages.

* cited by examiner

ENERGY EFFICIENT WIRELESS DETONATOR SYSTEM

CROSS-REFERENCE TO RELATED APPLICATIONS

This application is a U.S. national stage application of International Application No. PCT/ZA2020/050045 entitled "ENERGY EFFICIENT WIRELESS DETONATOR SYSTEM, which has an international filing date of 4 Sep. 2020, and which claims priority to South African Patent Application No. 2019/15911, filed 9 Sep. 2019.

BACKGROUND OF THE INVENTION

This invention relates to a detonating system.

US2008/0041261 relates to a wireless blasting system in which at least two components are adapted to communicate with each other over a short range wireless radio link. Use is made of so-called identification code carriers which are associated with respective detonators. The code carriers are capable of communication with each other and with a blast box.

Communication may be effected using various protocols, such as the Bluetooth protocol which operates at a frequency of about 2.45 GHz.

The specification of the aforementioned application also describes certain problems which are encountered when electronic blasting systems which are interconnected by way of wires are used in diverse sites. The use of a short range, high frequency, wireless radio link is intended to address some of these problems. However, the amplitude of a high frequency radio signal in rock is rapidly attenuated. It is then not always feasible to communicate directly with a detonator in a borehole. If the equivalent of an identification code carrier is used on a rock surface then the carrier is exposed to the prevailing environmental conditions and can easily be damaged and thereby rendered useless.

A magnetic signal at a frequency of, say, less than 20 KHz can however penetrate rock and soil without undue attenuation. It is then possible to make use of a transmitting antenna with a relatively large area which is positioned at a suitable protected location and which transmits at a power of several tens of watts communication signals to detonators which have appropriate receivers and which are placed in boreholes in the rock. This approach, which enables the use of the identification code carriers or equivalent devices to be dispensed with, is essentially of a unidirectional nature. Reliable communication links can be established from the transmitter to the various antennas which are associated with the detonators in the boreholes, but due to physical limitations of magnetic field propagation, it is not feasible to transmit from each detonator a signal in the reverse direction, over the same distance, to a receiving antenna which may be the same as a transmitting antenna.

A direct drawback thus is that a one-way communication process does not allow an operator to establish whether all detonators are receiving signals correctly from the transmitter. This means that there is no way of determining whether commands to the detonators from a control mechanism are being properly received. The absence of feedback from a detonator to the control mechanism means that safety and functional requirements are, inevitably, compromised.

Another factor, if a single antenna is used to transmit to all of the detonators in the boreholes is that the size of the antenna and its power demands may be substantial, particularly if the blast site extends over a large area. Other disadvantages include the practical problem of positioning and deploying a large antenna in an underground situation in which space may be limited and of then protecting the transmitting antenna from damage due to rock displaced in a subsequent blasting process.

Apart therefrom the consumption of power at each detonator is an important factor.

An object of the present invention is to address at least to some extent the aforementioned situation.

SUMMARY OF INVENTION

The invention provides a blasting system which includes a network comprising control equipment and a plurality of detonators which are arranged in respective boreholes, wherein each detonator has a signal reception and a signal transmitting capability, wherein a signal which is originated at the control equipment and which is transmitted from one detonator is received by at least one other detonator which in response thereto transmits a signal to at least one further detonator in the network, whereby the signal is moved from detonator to detonator through the network until a target detonator receives a signal which is intended for it.

Conversely, a signal originating at any detonator can be directed, using the aforesaid relay technique, to any other detonator or to the control equipment.

Each detonator preferably has a unique identifier, which is included in each signal transmitted by the detonator.

The signals may be at, or lower than, a frequency of 20 KHz. Preferably the frequency lies in the range of 3500 Hz to 4500 Hz typically of the order of 4 KHz. The relaying of the signals, in the described manner is, however, time consuming. Also the system has a slow data transfer rate which is attributable to the low frequency of operation and to the signal relay technique. To address this a synchronisation protocol is required to ensure that the detonator system can be fired effectively.

The invention provides a detonator which includes a transmitter, a receiver and a counter, wherein the counter is incremented at each of a plurality of successive time intervals thereby to define a respective time slot between each successive pair of increments and, within each time slot, a transmit interval, and a receive interval of a predetermined duration between two predetermined time points, the receive interval overlapping in time with the transmit interval, and wherein, within that time slot, the detonator is placed in a sleep mode for the duration of that time slot but excluding the duration of the receive interval and, during the receive interval, the detonator is placed in a wake-up mode.

The detonator is preferably automatically placed in an arm mode of a defined duration when the number of increments reaches a predetermined value. Further, if no fire signal is received by the detonator while it is in the arm mode, the arm mode may automatically be terminated.

The invention also extends to a detonator system which includes a plurality of detonators, each of the aforementioned kind, wherein each detonator is loaded into a respective borehole formed in a body of rock, and control equipment which is configured to communicate bi-directionally with at least one detonator, whereby a signal from the control equipment is relayed in succession via the transmitters and receivers of at least some of the plurality of detonators along a plurality of outbound paths to the plurality of detonators, and a signal from any detonator is relayed in succession via the respective transmitters and receivers of at least some of the detonators along a respective inbound path to the control equipment, wherein the respective counters of the detonators are simultaneously incremented so that a fire signal transmitted from the control equipment is communicated to all of the detonators during the duration of the arm mode.

BRIEF DESCRIPTION OF THE DRAWINGS

The invention is further described by way of example with reference to the accompanying drawings in which.

DESCRIPTION OF PREFERRED EMBODIMENT

Figure 1:
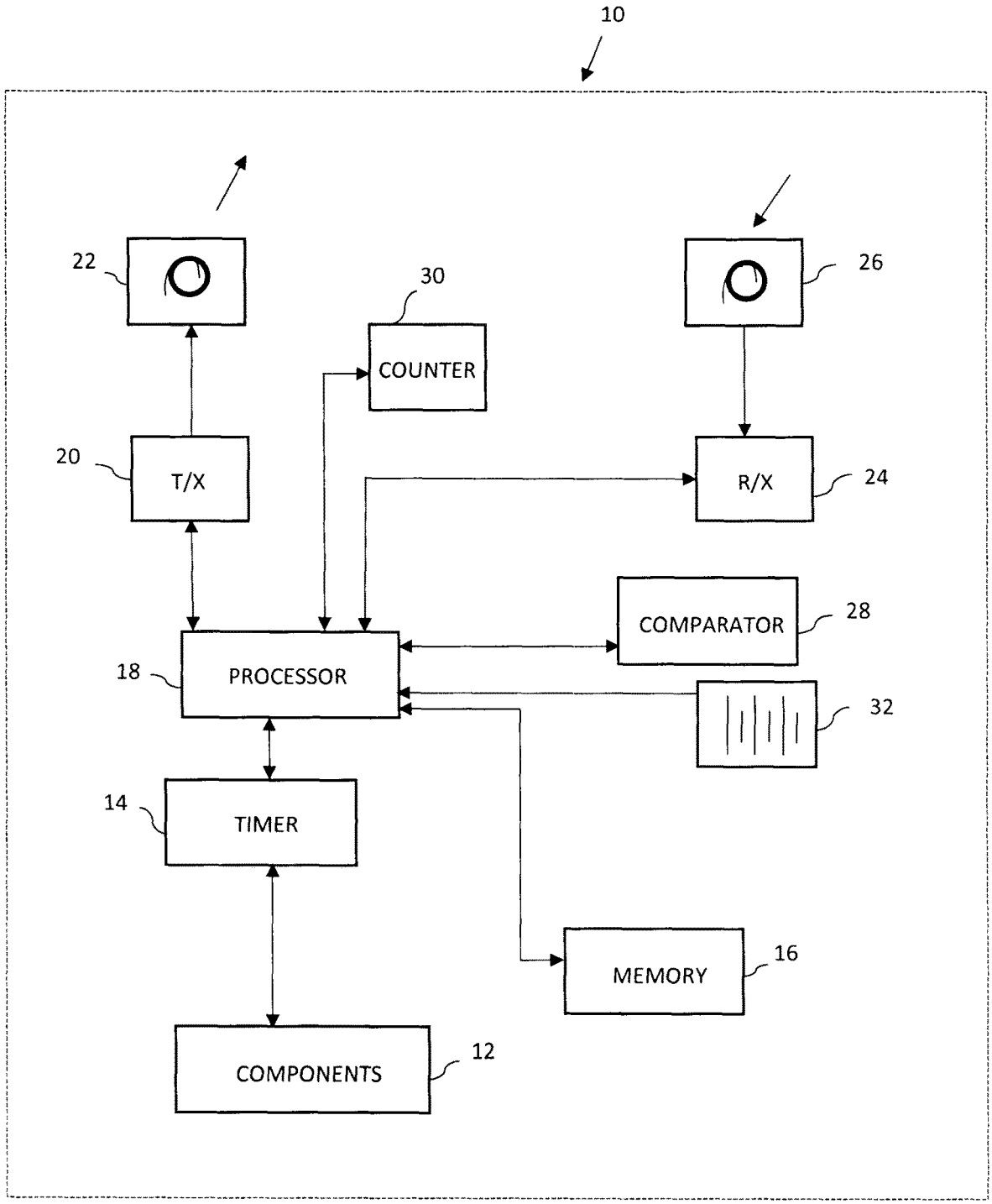
FIG. 1 is a block diagram representation of a detonator according to the invention.

FIG. 1 of the accompanying drawings illustrates in block diagram form a detonator 10 according to the invention.

The detonator 10 includes detonating components 12, of known elements, such as an initiator, a primary explosive and the like. These aspects are not individually shown nor described herein for they are known in the art.

The detonator 10 further includes a timer 14, a memory 16 in which is stored a unique identifier for the detonator, a processor 18, a transmitter 20 which is controlled by the processor 18 and which emits a signal through a custom-designed coil antenna 22, a receiver 24 which is connected to the processor 18 and which is adapted to receive a signal detected by a custom-designed coil antenna 26, a comparator 28, and a counter 30.

A battery 32 is used to power the electronic components in the detonator and to provide energy to the initiator to fire the detonator when required.

In use, the transmitter 20 produces a magnetic field which is transmitted by the antenna 22. The magnetic field is modulated with information output by the processor 18 in order to transmit information from the detonator. Similarly, the receiver 26 is adapted to decode a modulated magnetic field signal which is received by the antenna 26 and to feed information, derived from the demodulation process, to the processor 18. The receiver and transmitter function at a frequency which is at or lower than 20 KHz. For effective through the ground transmission the frequency may be in the range of 3500 Hz to 4500 Hz and typically is of the order of 4 KHz.

Figure 2:
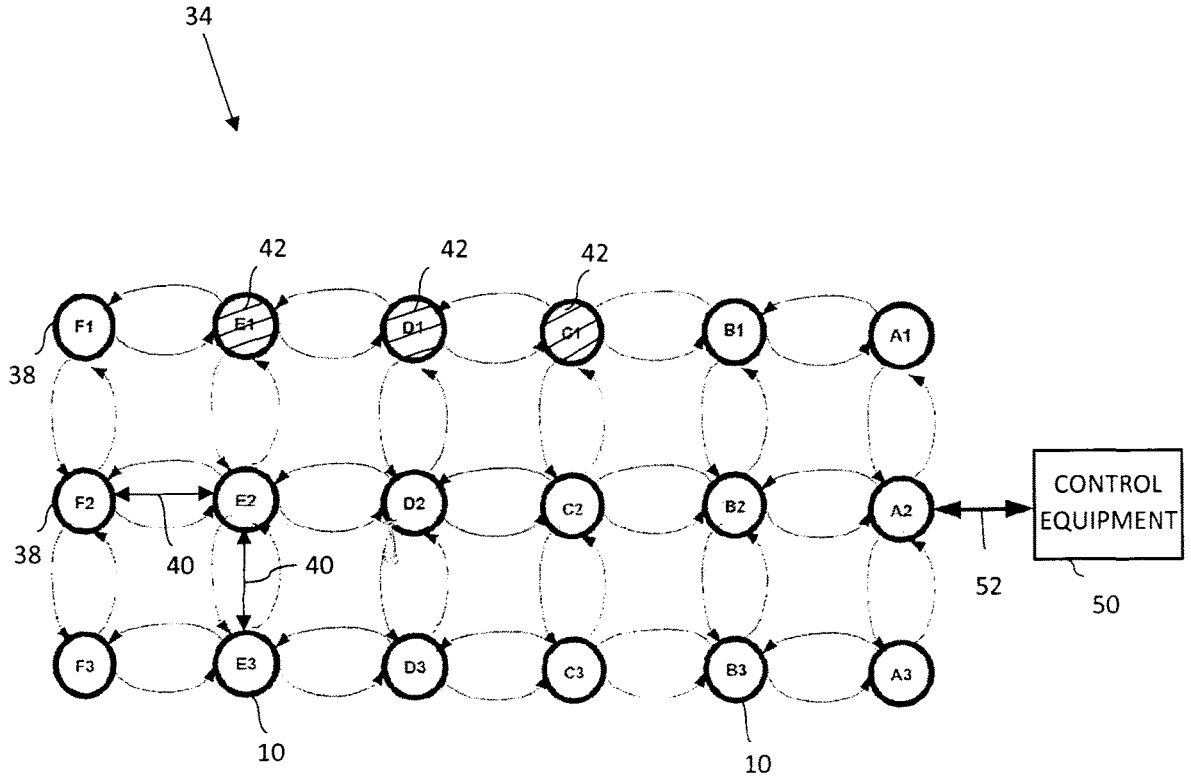
FIG. 2 schematically depicts a detonator system according to the invention.

FIG. 2 illustrates a detonator system 34 according to the invention which includes a plurality of boreholes 38 which are drilled in a body of rock in, say, an underground location. The spacings 40 between the boreholes 38, the depth of each borehole, and the position of each borehole, are determined by the application of known principles which are not described herein. Each borehole 38 is charged with an explosive composition 42 and is loaded with at least one detonator 10 of the kind described in connection with FIG. 1. For ease of identification the detonators are labelled A1 to A3, B1 to B3, C1 to C3, D1 to D3, E1 to E3 and F1 to F3.

The detonator system 34 also includes control equipment 50 which is used to establish and measure parameters of the blasting system in accordance with operating and safety techniques. The control equipment 50 is adapted to receive signals from the various detonators and to transmit signals to the various detonators as is described hereinafter.

The control equipment 50 is connected to the detonator A2, referred to herein for ease of identification as a sink detonator, via a physical link 52 such as conductive wires. A signal generated by the control equipment 50 is transmitted via the link 52 to the sink detonator A2. Information carried by this signal is extracted in the detonator A2 and that information is used to modulate a magnetic signal which is generated by the transmitter 20 in the detonator A2. A resulting near-field modulated magnetic signal is then transmitted from the coil antenna 22 of the detonator A2.

As is explained hereinafter it is possible for a signal generated at the control equipment 50 to be transmitted via the mesh network shown in FIG. 2 to a particular predetermined detonator and for a signal to be returned from that detonator to the control equipment 50. In the first case the signal, travelling on an outbound path, is relayed sequentially from one detonator to another and is guided to its particular destination. In the second case the signal travels, via the relay technique, on an inbound path to the control equipment 50.

Assume that the sink detonator A2 transmits a signal which is received by a number of adjacent detonators. In FIG. 2 these adjacent detonators are illustrated at least as the detonators A1, B2 and A3.

Included in each modulated transmitted signal is the unique identifier of the relevant detonator, taken from the memory 16 of the detonator.

Each detonator 10 which receives a signal then transmits a responsive signal.

Referring again by way of example only to the detonator B2 the respective components in the detonator B2 cause the generation of a modulated magnetic signal which is transmitted via the respective coil antenna 22. That transmitted signal carries information identifying the sequential path from the control equipment 50, to the detonator A2, and to the detonator B2, and is received at least by the adjacent detonators C2, B3, A2 and B1.

Assume, referring to the detonator B3 (again only by way of example) that the detonator B3, in response to the received signal, emits a modulated magnetic signal of the nature which has been described. That signal is received at least by the adjacent detonators B2, C3 and A3.

The process continues in this manner until each detonator has received a corresponding signal which originated from the control equipment 50. It should be borne in mind that each transmitted signal travels in three dimensions. However, for explanatory purposes herein, signal propagation is described as taking place in two dimensions.

Subsequently, a signal containing identifiers of the respective detonators, is propagated along various paths through the mesh network towards the sink detonator A2 which, in turn, transfers such signal to the control equipment 50.

The control equipment 50 is then capable of establishing a computer representation of the configuration which is shown in FIG. 2 i.e. of the various boreholes and the detonators and the identities of the detonators. Through the use of appropriate software the control equipment 50 determines how a signal which is intended for any particular detonator 10, which is identified uniquely by means of its identity number, can be sent to that detonator on an outbound path through the mesh network of detonators. Additionally, the aforementioned process enables each detonator to establish the identity of each adjacent detonator with which it can communicate in a bi-directional manner.

Once the routing information has been established it is possible for the control equipment 50 to generate a message that is intended for any particular detonator, as identified by its identity number, and then to transmit an outbound message which is intended only for that detonator. In the return direction a detonator can, for example after carrying out integrity and functional capability tests, generate and transmit an inbound signal to the control equipment 50. In each instance, the signal goes along a predetermined path which is determined primarily by the routing information referred to. The control equipment 50 is then able to verify the integrity of the entire blasting system before initiating a fire signal.

From the aforegoing description it is apparent that a signal generated and transmitted by the control equipment 50 can be directed after passing through a plurality of designated receive and transmit sequences at respective detonators 10 to a target detonator. Conversely a signal from any detonator in the system can be directed to the control equipment 50, passing through the receiver and transmitter of each respective detonator. It is therefore possible for the control equipment 50 to interrogate each detonator and to establish that it is functional. It is however not possible to rely on this technique to synchronise the ignition of the detonators for the time which is taken for a signal to travel from the control equipment 50 to one detonator 10 will invariably be different from the time taken for a signal to travel from the control equipment to another detonator. To address this a blast time synchronisation process is required.

When the blasting system network is established each detonator 10 is instructed, unless a cancel signal is previously received, to enter an arm mode at a particular time. This can be done in different ways but the synchronisation technique, in this example, relies on the notion of a respective slot number which is a count held in a memory of the detonator.

At time zero the slot number count in each detonator is set to zero. This is done simultaneously for all the detonators. The detonators are then installed in the blasting system. At regular intervals determined by the timer 14 in each detonator the slot number is incremented by a unit i.e. a count value. Typically the slot number is incremented by a count value every 64 seconds. Each time a detonator forwards a message, the slot number for that detonator is attached to the message and is forwarded together with the message. The slot number is also incremented by a unit value.

When the slot number reaches a predetermined value each detonator is placed into an arm mode. This occurs simultaneously for all of the detonators. The arm mode endures for a predetermined time period which is sufficiently long for the control equipment 50 to transmit a fire signal along the various outbound paths to each of the detonators. At the end of that time period a fire command is implemented and the respective detonators are ignited. Conversely if the fire signal is not received at a detonator within the predetermined time period then, at the end of that time period, the arm command is cancelled and the detonator ignition takes place.

The aforementioned technique allows the detonators to be fired simultaneously. The system can however be adapted to enable the control equipment 50 to pass a respective time delay period, calculated by an algorithm in the control equipment, to each of the respective detonators. If no delay time is attributed to a particular detonator then that detonator is fired at the end of the aforementioned predetermined time period. If a time delay is attributed to a particular detonator then the timing of the delay commences at the end of the predetermined period and at the end of the time delay the respective detonator is fired.

The slot number approach can also be employed for controlling the operation of the detonators to minimise power consumption. In this regard reference is made to FIG. 3 which shows a timing diagram for a detonator A and a timing diagram for a detonator B. A timing interval of 64 seconds (this value is exemplary and non-limiting) is commenced for each detonator at a time T1. That timing interval ends 64 seconds later for each detonator at a time T2 (The interval from T1 to T2 is also referred to as a frame 58). The detonator B is "woken" and placed in a receive mode at time T3. A receive interval 60 terminates at a time T4. Outside of the interval 60, in each time slot from T1 to T2, the detonator B is in a low power consumption mode i.e. it is "asleep". In accordance with the procedure which has been described, at a time T5 the detonator A is woken and placed in a transmit mode and enters a transmit interval 64 which ends at a time T6. The duration of the interval 64 from T5 to T6 is less than the duration of the interval 60 from T3 to T4. This is to account for any timing errors which may occur, during relaying of the signals, thereby to ensure that whenever the detonator A is in a transmit mode the detonator B is in a receive mode. Security of signal transmission is thereby achieved. The detonator A is only woken in the period T5 to T6—otherwise it is asleep.

In a subsequent time slot the detonator B would normally be placed in a transmit mode and the detonator A, together with several other detonators which are adjacent to the detonator B, would be placed in a receive mode. A detonator which is not being called upon to transmit nor to receive is left in the sleep mode.

Figure 3:
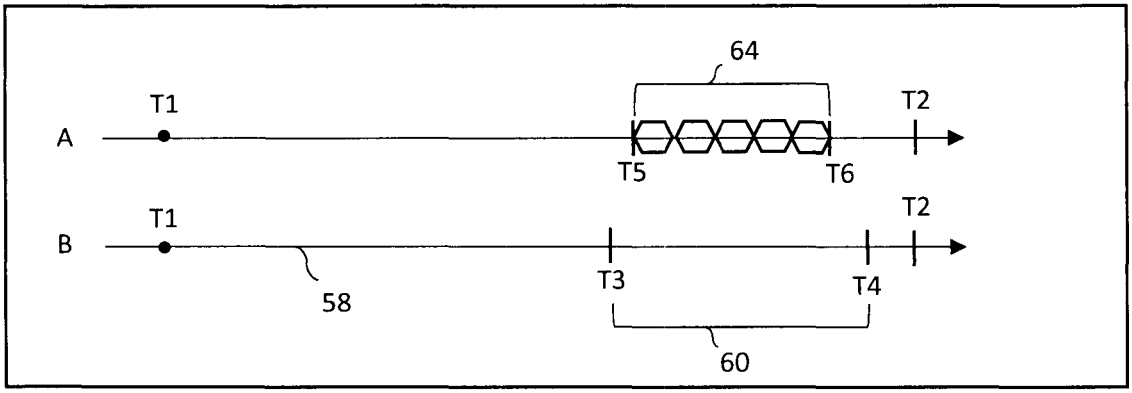
FIG. 3 is a timing diagram illustrating an aspect of a synchronisation technique embodied in the invention.

The process described in connection with FIG. 3 is effected for each detonator which is to transmit a signal and for adjacent detonators for which the transmitted signal is intended.

The time period taken to transmit a message from the control equipment 50 to any detonator and for that detonator to return a message to the control equipment is referred to as the "latency" of the network. This time period is linked to the rate of data transmission in the detonator system and to the duration of each time slot.

Referring again to FIG. 3 it is evident that more than one receive interval, each of a duration equal to the period from T3 to T4, can be included in the interval T1 to T2 i.e. in each frame. If necessary the length of a frame can be increased to accommodate additional receive intervals. The data transmission rate can thereby be increased and the latency of the network can be lowered but this is at the expense of current consumption. An advantage is that the time taken to bring the blasting system to the arm stage and then to fire is reduced.

The invention claimed is:

1. A method of operating a blasting system which includes a network comprising control equipment and a plurality of detonators which are arranged in respective boreholes, wherein each detonator has a signal reception and a signal transmitting capability, a counter and a unique identifier and wherein, in terms of the method, a signal which is originated at the control equipment and which is transmitted by a sink detonator is received by at least one other detonator which in response thereto transmits a signal to at least one further detonator in the network, whereby the signal is moved from detonator to detonator through the network until each detonator in the network has received a corresponding signal and a target detonator has received a signal which is intended for it where-upon a signal containing identifiers of the respective detonators is propagated through the network to the sink detonator which transfers such signal to the control equipment which then establishes a computer representation of the network including the boreholes, the detonators and the identifiers of the detonators, and wherein the respective counters of the detonators are simultaneously incremented and each detonator is placed in an arm mode of a defined duration when the number of increments in that detonator reaches a predetermined value and wherein a fire signal from the control equipment is transmitted to all of the detonators during the duration of the arm mode.

2. A method of operating a blasting system according to claim 1 wherein the signals are at a frequency in the range of 3500 Hz to 4500 Hz.

3. A method according to claim 1 which includes the step of determining how a signal which is intended for any particular detonator which is identified uniquely by means of its identifier can be sent to that detonator from the control equipment through the network.

4. A method according to claim 3 which includes the step for each detonator in the network of establishing the identifier of each adjacent detonator with which such each detonator can communicate in a bi-directional manner.

5. A method according to claim 4 which includes the step at the control equipment of establishing routing information which determines how a signal which is intended for any particular detonator, identified uniquely by means of its identifier, can be sent to that detonator from the sink detonator through the network.

6. A method according to claim 5 which includes the steps at a detonator of carrying out integrity and functional capability tests, generating a signal and transmitting such signal to the control equipment along a predetermined path in the network which is determined primarily by said routing information.

7. A method according to claim 6 wherein the control equipment interrogates each detonator to establish that it is functional by means of the following steps: generating a signal at the control equipment, transmitting the signal by means of a plurality of designated receive and transmit sequences at respective detonators to a target detonator and directing a signal from the target detonator to the control equipment by passing the signal through the receiver and transmitter of each respective detonator.

* * * * *